US010741106B2

(12) United States Patent
Youn

(10) Patent No.: US 10,741,106 B2
(45) Date of Patent: Aug. 11, 2020

(54) THREE-DIMENSIONAL ADVERTISEMENT DEVICE

(71) Applicant: P&I SYSTEM, Jeju-si, Jeju-do (KR)

(72) Inventor: Eun Seok Youn, Seoul (KR)

(73) Assignee: P&I SYSTEM, Jeju-si, Jeju-do (KR)

( * ) Notice: Subject to any disclaimer, the term of this patent is extended or adjusted under 35 U.S.C. 154(b) by 0 days.

(21) Appl. No.: 16/471,278

(22) PCT Filed: Dec. 19, 2016

(86) PCT No.: PCT/KR2016/014859
§ 371 (c)(1),
(2) Date: Jun. 19, 2019

(87) PCT Pub. No.: WO2018/117277
PCT Pub. Date: Jun. 28, 2018

(65) Prior Publication Data
US 2019/0318671 A1 Oct. 17, 2019

(51) Int. Cl.

| | |
|---|---|
| ***G09F 9/37*** | (2006.01) |
| ***G09F 9/40*** | (2006.01) |
| ***G09F 19/12*** | (2006.01) |
| ***G09F 19/22*** | (2006.01) |

(52) U.S. Cl.
CPC ..... *G09F 9/375* (2013.01); *G09F 9/40* (2013.01); *G09F 19/12* (2013.01); *G09F 19/22* (2013.01)

(58) Field of Classification Search
CPC ..... G09F 9/375; G09F 19/22; G09F 19/12; G09F 9/40; G09F 13/02; G09F 13/00; G09F 9/37
See application file for complete search history.

(56) References Cited

U.S. PATENT DOCUMENTS 4,163,332 A * 8/1979 Salam ..... G09F 9/375 340/815.44
4,983,956 A * 1/1991 Salam ..... G09F 9/375 340/815.56

(Continued)

FOREIGN PATENT DOCUMENTS

KR 2003-0090992 A 12/2003
KR 20-0438312 Y1 1/2008

(Continued)

*Primary Examiner* — Cassandra Davis
(74) *Attorney, Agent, or Firm* — Novick, Kim & Lee, PLLC; Jae Youn Kim

(57) ABSTRACT

Disclosed is a three-dimensional advertisement device. The present invention includes: a frame having a predetermined shape; a plurality of unit cells supported by the frame and arrayed in an X-Y matrix; and a controller for selectively driving the unit cells according to an external input signal, wherein the unit cell includes: a cell plate having a magnet on a rear surface thereof and having an upper end hinge-coupled to the frame, the cell plate being vertically disposed; and an electromagnet arranged to face the magnet of the cell plate to enable the cell plate to rotate forward when power is applied thereto according to a signal of a controller. The cell plate of the unit cells includes a reflection plate such that advertisement text is three-dimensionally expressed through a combination of the cell plates which rotate to be opened.

5 Claims, 6 Drawing Sheets

(56) References Cited

U.S. PATENT DOCUMENTS

| | | | | | |
|---|---|---|---|---|---|
| 5,148,156 | A * | 9/1992 | Huber | ..... | G09F 9/375<br>340/815.55 |
| 5,325,108 | A * | 6/1994 | Salam | ..... | G09F 9/375<br>345/108 |
| 6,677,922 | B1 * | 1/2004 | Johnson | ..... | G09F 9/305<br>345/84 |

FOREIGN PATENT DOCUMENTS

| | | | |
|---|---|---|---|
| KR | 10-2013-0116126 | A | 10/2013 |
| KR | 10-2014-0024145 | A | 2/2014 |
| KR | 10-1487904 | B1 | 2/2015 |
| KR | 10-2016-0139557 | A | 12/2016 |
| KR | 10-1722980 | B1 | 4/2017 |

* cited by examiner

THREE-DIMENSIONAL ADVERTISEMENT DEVICE

TECHNICAL FIELD

The present invention relates to an advertising device, and more particularly to a three-dimensional advertising device that is capable of three-dimensionally expressing advertising content, thereby obtaining an excellent visual communication effect, that is capable of freely changing the advertising content as needed, and that is also capable of expressing the advertising content in the form of video.

BACKGROUND ART

As is generally known, stores, companies, or organizations announce trade names, handling items, brand names, items of business, etc. using various advertising means in order to attract attention of passersby who pass thereby. A display device, which is capable of expressing brilliant images, an electric bulletin board, which selectively expresses predetermined advertising content, and a signboard, which is attached to the outer wall of a building in the state in which a specific text is marked thereon, are used as the advertising means. However, a signboard is mainly used in consideration of expense.

Consequently, it is most important for the advertising means, such as a signboard, to effectively attract people's attention while sufficiently representing the business activity of the field of interest.

In some cases, a color sheet, on which a text is marked, is attached to the surface of a panel of the signboard. In most cases, however, in order to be distinguishable at night and to improve attention-gathering ability, thereby maximizing the advertising effect, the panel of a signboard, on which advertisement text is marked, is made of a light-transmissive sheet, such as an acrylic sheet, and an illumination device, such as a fluorescent lamp or an LED, is mounted in the signboard to emit light.

Such a signboard is very advantageous in terms of expense. However, since simply a specific text or figure is marked, and therefore only limited content is displayed, the advertising effect is extremely limited, and the sheet must be replaced or the signboard itself must be installed again in order to express new advertising content, which is troublesome.

In addition, since the advertisement text is marked in a planar fashion using printing, etc., distinctiveness and attention-gathering ability are not very high, whereby the advertising effect is deteriorated.

In order to solve the above problems, the advertisement text is realized using independent three-dimensional cells, as disclosed in Korean Registered Utility Model No. 20-0438312. Even in this case, however, it is difficult to overcome the limitation of the signboard on which a specific text is marked, although visibility is somewhat improved and a more beautiful external appearance is expressed.

Meanwhile, in recent years, an electric bulletin board, configured to have a structure in which a plurality of LED lamps is arranged in the form of an X-Y matrix and selected ones of the LED lamps are turned on in response to an external input signal, whereby it is possible to variously express a desired advertisement text and to display simple video or to dynamically display advertisement text, has been proposed, as disclosed in Korean Patent Application Publication No. 2003-0090992.

The distinctiveness and attention-gathering ability of the above electric bulletin board are improved compared to a general signboard. However, the electric bulletin board is incapable of replacing a signboard, which is a popularized advertising means, due to the complicated circuit construction and high expense thereof. Furthermore, the electric bulletin board is capable of expressing advertisement text only in a planar fashion due to the structural characteristics thereof. As a result, the electric bulletin board still has appearance-related limitations similar to those of the signboard.

DISCLOSURE

Technical Problem

The present invention has been made in view of the above problems of the conventional art, and it is an object of the present invention to provide a three-dimensional advertising device that is capable of three-dimensionally expressing advertising content, thereby obtaining an excellent visual communication effect, and that is capable of greatly improving visibility and attention-gathering ability using a simple structure at low expense, thereby maximizing an advertising effect.

It is another object of the present invention to provide a three-dimensional advertising device that is capable of freely changing advertising content as needed and that is also capable of expressing the advertising content in the form of video, thereby overcoming the limitations of advertising expression and distinctiveness faced by a general signboard.

Technical Solution

In accordance with the present invention, the above and other objects can be accomplished by the provision of a three-dimensional advertising device including a frame configured to have a predetermined shape, a plurality of unit cells arranged on the frame in the form of an X-Y matrix so as to be supported by the frame, and a controller for controlling a power supply device in response to an external input signal to selectively supply electric power to selected ones of the unit cells such that the unit cells are selectively driven, wherein each of the unit cells includes a cell plate having a magnet disposed at the rear surface thereof, the upper end of the cell plate being hingedly coupled to the frame such that the cell plate is disposed vertically, and an electromagnet disposed so as to be opposite the magnet of the cell plate while having the same polarity, the electromagnet being configured to turn the cell plate forwards by repulsive force when electric power is supplied to the electromagnet according to a signal from the controller.

According to a preferred characteristic of the present invention, the cell plate of each of the unit cells may be made of a reflective plate, whereby it is possible to three-dimensionally express advertisement text through a combination of cell plates that are turned and opened.

According to another preferred characteristic of the present invention, the cell plate of each of the unit cells may include a main body, the front surface of which may be colored with a dark color, the upper end of the main body being hingedly coupled to the frame, and a plurality of blades provided at the front surface of the main body so as to be disposed at a uniform interval in a vertical direction, the blades being installed so as to be inclined downwards in order to cover the front surface of the main body, the front surface of each of the blades being colored with a bright color, whereby it is possible to three-dimensionally display various advertisements depending on the turning angle of each of the cell plates.

According to a further preferred characteristic of the present invention, the controller may adjust the intensity of the electromagnet of each of the unit cells in response to an external input signal in order to change the turning angle of the cell plate or to repeatedly widen or narrow the cell plate, whereby it is possible to display desired advertisement in three dimensions and to dynamically display the advertisement based on driving settings.

Advantageous Effects

In the three-dimensional advertising device according to the present invention described above, cell plates of a plurality of unit cells are turned forwards so as to protrude in order to express an advertisement, whereby it is possible to express advertising content in three dimensions. Consequently, it is possible to obtain an excellent visual communication effect, and at the same time, it is possible to greatly improve visibility and attention-gathering ability, whereby it is possible to maximize an advertising effect.

In particular, the unit cells, which are arranged in the form of an X-Y matrix, are selectively turned in response to an external input signal in order to display an advertisement. Consequently, it is possible to freely change advertising content as needed without replacing a signboard or exchanging a printed sheet, unlike the conventional art. In addition, it is possible to dynamically express the advertising content, whereby it is possible to definitely overcome the limited advertising expression and distinctiveness of a general signboard and to obtain an excellent advertising effect.

In addition, it is possible to freely express and change desired advertising content while performing dynamic expression using only a relatively simple structure that is capable of adjusting the intensity of the electromagnet in order to turn each of the cell plates, whereby it is possible to achieve an excellent advertising effect at low cost.

BEST MODE

Concrete features and other advantages of a three-dimensional advertising device according to the present invention will be more apparent from the following description of preferred embodiments made with reference to the accompanying drawings.

Figure 1:
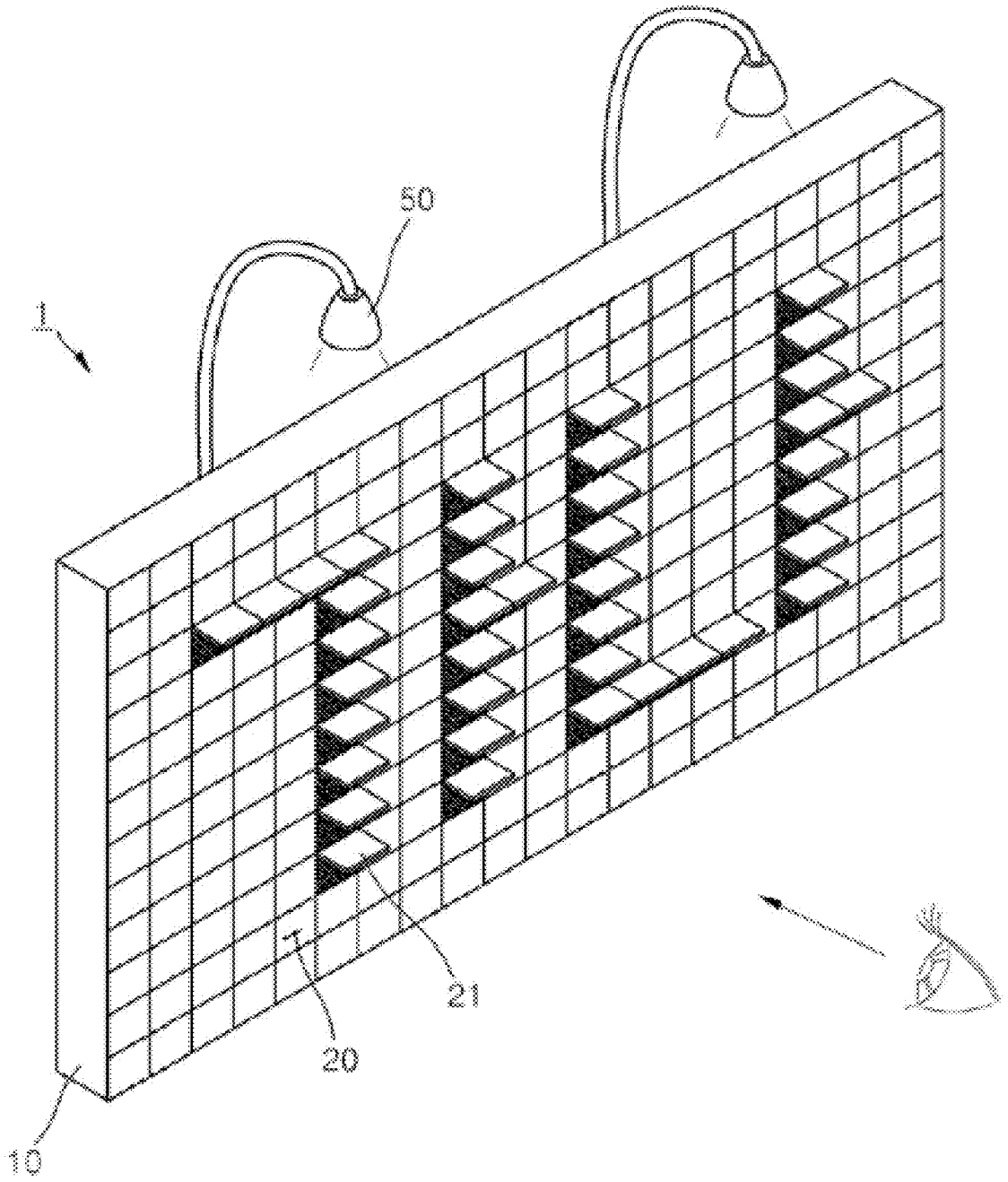
FIG. 1 is a perspective view schematically showing a three-dimensional advertising device according to the present invention.
Figure 2:
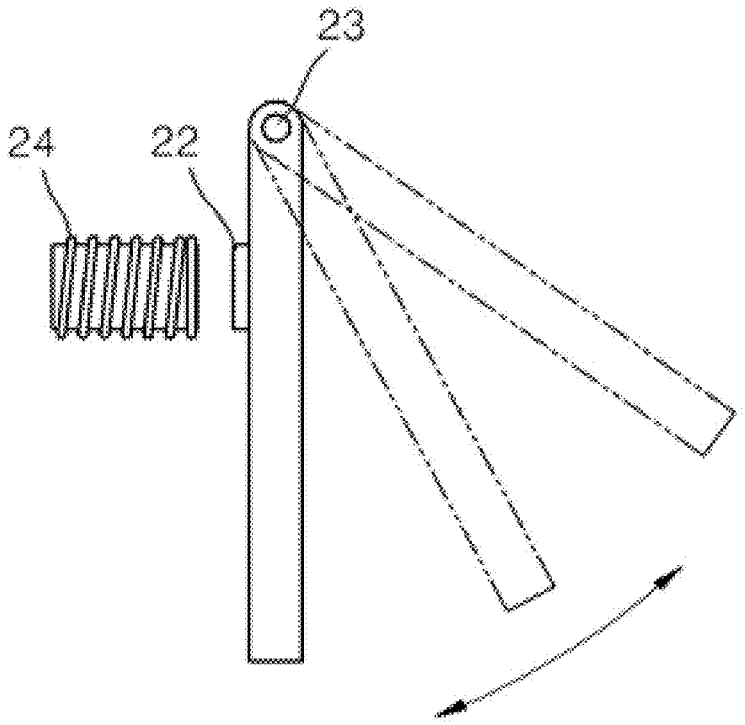
FIG. 2 is a side view schematically showing a unit cell constituting the three-dimensional advertising device according to the present invention.
Figure 3:
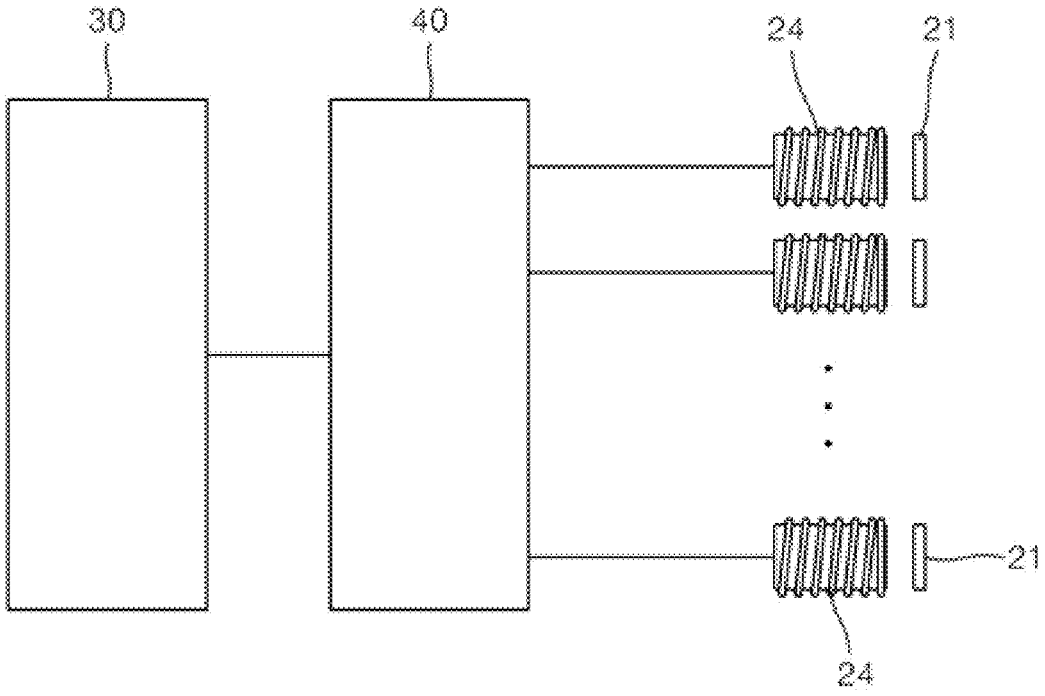
FIG. 3 is a block diagram schematically showing the construction of the three-dimensional advertising device according to the present invention.

Referring to FIGS. 1 to 3, a three-dimensional advertising device 1 according to the present invention includes a frame 10 configured to have a predetermined shape, a plurality of unit cells 20 arranged on the frame 10 in the form of an X-Y matrix so as to be supported by the frame, and a controller 30 for selectively turning the respective unit cells 20 in response to an external input signal.

The shape of the frame 10 is not particularly restricted, as long as the frame is capable of turnably supporting a cell plate 21 of each of the unit cells 20. For example, the frame 10 may be a quadrangular frame including a back panel (not shown), or may be a frame having a closed rear surface.

Preferably, the front surface of the back panel of the frame 10 is colored with as dark a color as possible, such as black. The reason for this is that, in the case in which the cell plates 21 of the unit cells 20 are turned forwards so as to protrude and are then opened, the opened unit cells 20 are definitely visually distinguished from the surroundings due to the characteristics of the present invention, in which the opened parts constitute three-dimensional advertising content, whereby the advertising content is more clearly expressed.

Each unit cell 20 includes a cell plate 21, which constitutes the front surface of the frame 10 together with adjacent unit cells 20, and an electromagnet 24 for turning the cell plate 21 forwards so as to protrude.

To this end, the upper end of the cell plate 21 is supported at the frame 10 via a hinge 23 such that the cell plate is disposed vertically due to the weight thereof, and the cell plate is provided at the rear surface thereof with a magnet 22, which is opposite the electromagnet 24. The faces of the electromagnet 24 and the magnet 22 of the cell plate 21 that face each other are configured to have the same polarity such that, when electric power is supplied to the electromagnet 24, the cell plate 21 is turned forwards so as to protrude due to the repulsive force between the electromagnet and the magnet.

In order to definitely express and discriminate the advertising content, the cell plate 21 itself or the front surface of the cell plate is preferably made of a reflective plate such that the advertising content formed by the cell plate 21, which is turned and opened, is clearly distinguished from adjacent unit cells 20, which are not opened.

The hinge 23 may be individually applied to each unit cell. Preferably, however, the hinge is configured to turnably support cell plates 21 of all unit cells 20 located in one line at the same time.

An external input device may be connected to the controller 30. The controller controls a power supply device 40 in response to advertising content set by the input device such that predetermined electric power is selectively supplied to the electromagnet of the selected unit cell 20. In addition, the voltage that is applied to the electromagnet 24 of the selected unit cell 20 is selectively adjusted in response to the input advertising content in order to adjust the intensity of the electromagnet 24.

Even in the case in which the unit cells 20 are selected depending on the advertising content, therefore, the turning angles of the cell plates 21 thereof may be the same as each other or may be different from each other, whereby it is possible to express various kinds of advertising content in the present invention, in which the advertising content is expressed based on the turning and opening of the cell plates 21.

Particularly, in the case in which the cell plates 21 that are turned forwards and opened are repeatedly widened or narrowed within a predetermined angular range or in the case in which the same advertising content is alternately or continuously applied to adjacent unit cells 20, it is also possible to dynamically express three-dimensional advertising content just like an LED electric bulletin board.

Meanwhile, for example, as shown in FIG. 1, the three-dimensional advertising device according to the present invention may further include an illumination means 50 disposed at the upper end of the frame 10 for illuminating the unit cells 20 disposed at the front surface of the frame. It is possible to express the advertising content in three dimensions even at night using the illumination means 50. In addition, a color may be applied to the illumination means 50, whereby it is possible to attract people's attention through more improved visibility and more increased distinctiveness.

Figure 4:
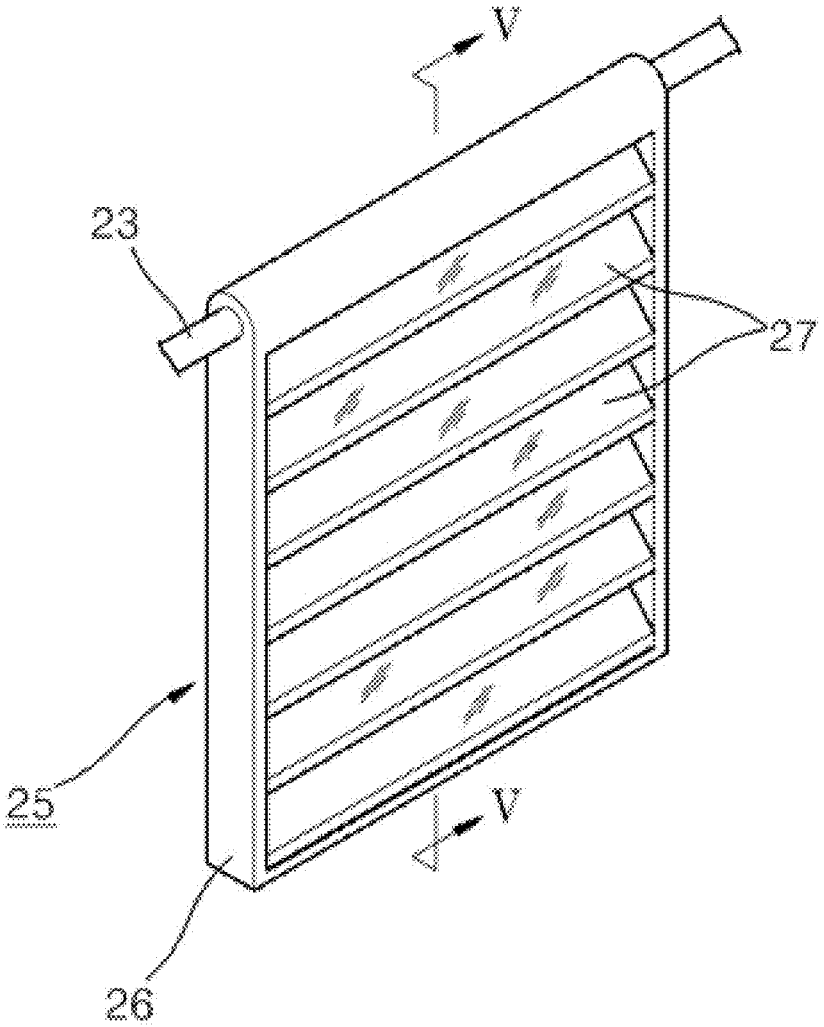
FIG. 4 is a perspective view showing another embodiment of the unit cell of the three-dimensional advertising device according to the present invention.
Figure 5:
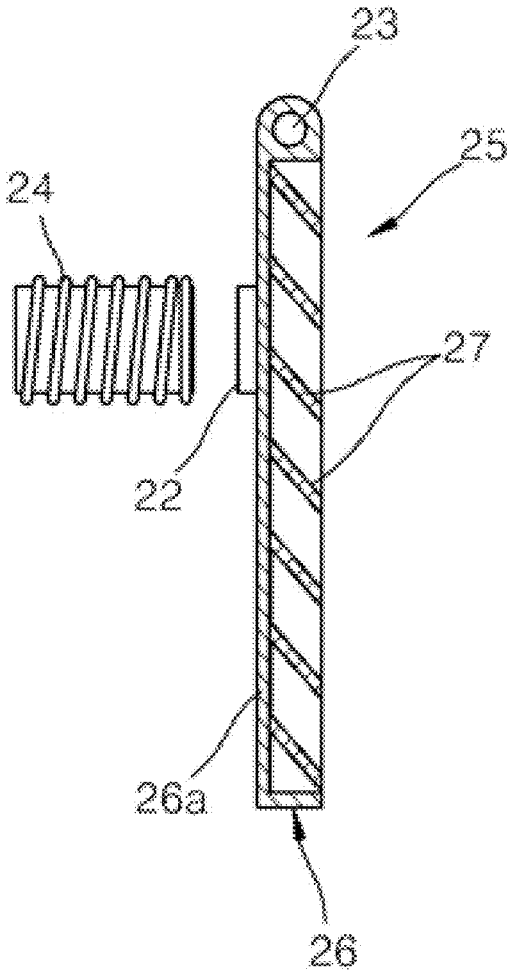
FIG. 5 is a sectional view taken along line V-V of FIG. 4.
Figure 6:
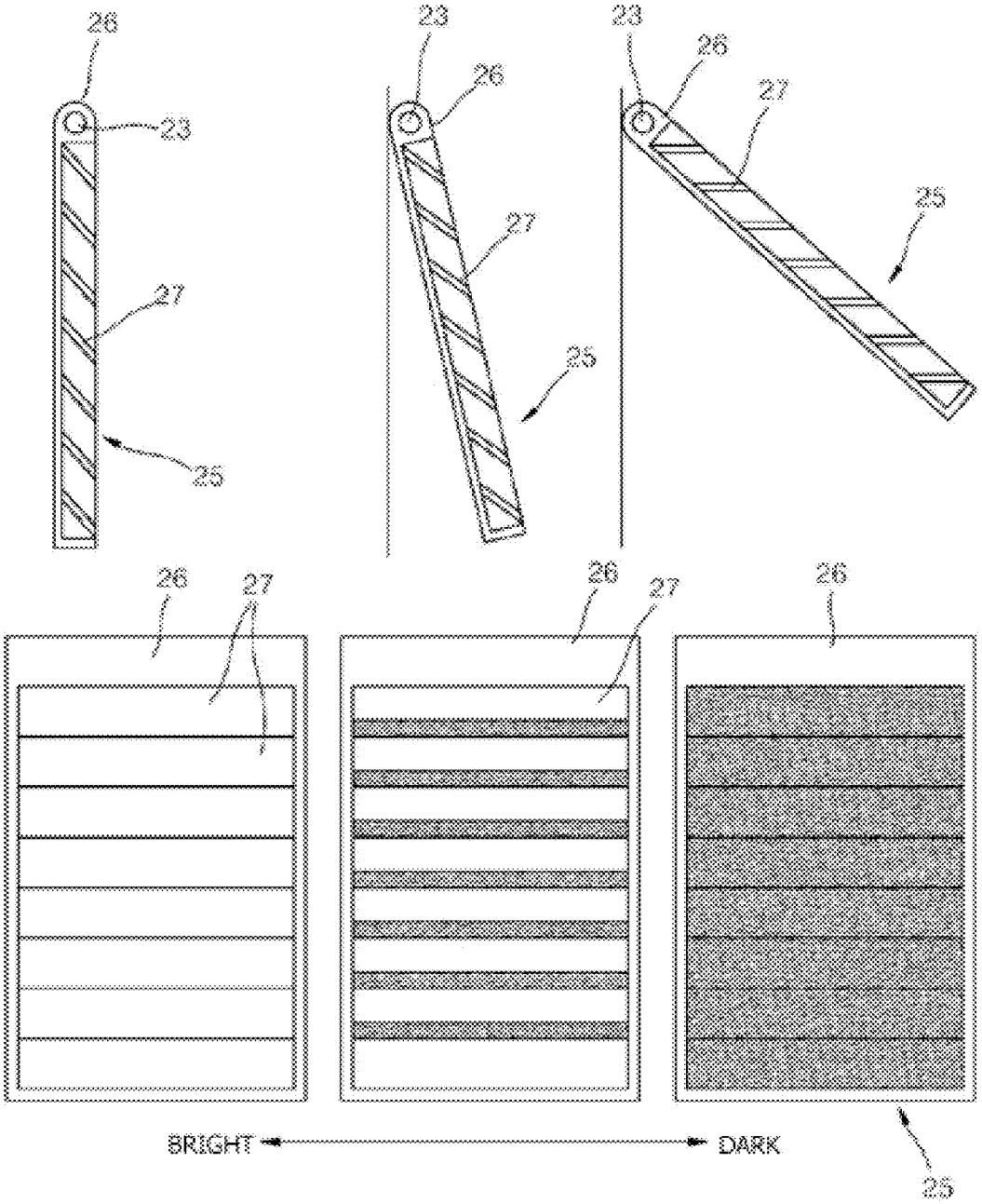
FIG. 6 is a view illustrating the principle by which the unit cell of the three-dimensional advertising device according to the present invention shown in FIG. 4 is operated.

Another embodiment of a cell plate 25 of the unit cell 20 according to the present invention is schematically shown in FIGS. 4 to 6.

In this embodiment, the cell plate 25 includes a main body 26, the front surface of which is colored with a dark color, and a plurality of blades 27 provided at the front surface of the main body 26 so as to be inclined downwards, compared to the construction of the previous embodiment.

For example, the main body 26 may be configured in the shape of a frame having a back plate 26*a*, at the rear surface of which a magnet 22 is provided. The upper end of the main body is turnably supported at the frame 10 via a hinge 23, and the front surface of the back plate 26*a* is colored with a dark color, such as black.

The blades 27 are disposed so as to be spaced apart from each other by a uniform distance in the vertical direction, and are installed so as to cover the front surface of the main body 26 when the cell plate 25 is oriented vertically in the state of not being opened. The front surface of each of the blades 27 is disposed at the front surface of the main body, and is colored with a bright color.

In the case in which no electric power is supplied to the electromagnet 24, the cell plate 25 is oriented vertically by the weight thereof, whereby the dark color thereof is hidden by the blades 27. In the case in which electric power is supplied to the electromagnet 24, however, the cell plate 25 is turned forwards and opened due to the repulsive force between the electromagnet 24 and the magnet 22. The front surface of the back plate 26*a* of the dark main body 26 is exposed to express advertising content depending on the turning angle of the cell plate.

Even in the case in which the turning angle of the cell plate 25, at which the cell plate protrudes forwards, is not great, it is possible to perfectly express the advertising content. In particular, since the cell plate 25 itself has contrast by which the advertising content is displayed, it is possible to express the three-dimensional effect of the advertising content more clearly and definitely than the previous embodiment.

INDUSTRIAL APPLICABILITY

A three-dimensional advertising device according to the present invention includes a frame 10 configured to have a predetermined shape, a plurality of unit cells 20 arranged on the frame in the form of an X-Y matrix so as to be supported by the frame, and a controller 30 for controlling a power supply device in response to an external input signal to selectively supply electric power to the unit cells such that the unit cells are selectively driven, and each of the unit cells is configured to be operated by a magnet, disposed at the rear surface thereof, and an electromagnet.

As a result, each of the unit cells is turned forwards by the magnet and the electromagnet so as to protrude such that the advertisement is expressed, whereby it is possible to three-dimensionally express advertising content. Consequently, it is possible to obtain an excellent visual communication effect, and at the same time, it is possible to greatly improve visibility and attention-gathering ability, whereby it is possible to maximize an advertising effect.

In addition, it is possible to freely express and change desired advertising content while performing dynamic expression using only a relatively simple structure that is capable of adjusting the intensity of the electromagnet in order to turn each of the cell plates. Therefore, the three-dimensional advertising device according to the present invention has industrial applicability as a practical device that is capable of achieving an excellent advertising effect at low cost.

The invention claimed is:

1. A three-dimensional advertising device comprising:

a frame configured to have a predetermined shape;

a plurality of unit cells arranged on the frame in a form of an X-Y matrix so as to be supported by the frame; and a controller for controlling a power supply device in response to an external input signal to selectively supply electric power to selected ones of the unit cells such that the unit cells are selectively driven, wherein each of the unit cells comprises:

a cell plate having a magnet disposed at a rear surface thereof, an upper end of the cell plate being hingedly coupled to the frame such that the cell plate is disposed vertically; and an electromagnet disposed so as to be opposite the magnet of the cell plate while having a same polarity, the electromagnet being configured to turn the cell plate forwards by repulsive force when electric power is supplied to the electromagnet according to a signal from the controller, wherein the cell plate of each of the unit cells comprises:

a main body having a front surface colored with a dark color, and an upper end hinge-coupled to the frame; and a plurality of blades provided at a front surface of the main body so as to be disposed at a uniform interval in a vertical direction, the blades being installed so as to be inclined downwards in order to cover the front surface of the main body, wherein a front surface of each of the blades is colored with a bright color.

2. The three-dimensional advertising device according to claim 1, wherein the cell plate of each of the unit cells is made of a reflective plate.

3. The three-dimensional advertising device according to claim 2, wherein the controller adjusts an intensity of the electromagnet of each of the unit cells in response to the external input signal in order to change a turning angle of the cell plate.

4. The three-dimensional advertising device according to claim 1, wherein the controller adjusts an intensity of the electromagnet of each of the unit cells in response to the external input signal in order to change a turning angle of the cell plate.

5. The three-dimensional advertising device according to claim 1, further comprising an illumination means supported at the frame for illuminating the unit cells.

* * * * *